US010631086B1

(12) United States Patent
Bagg

(10) Patent No.: US 10,631,086 B1
(45) Date of Patent: Apr. 21, 2020

(54) GAS-FILLED ACOUSTIC SUSPENSION SPEAKER

(71) Applicant: Charles G. Bagg, Fitchburg, MA (US)

(72) Inventor: Charles G. Bagg, Fitchburg, MA (US)

( * ) Notice: Subject to any disclaimer, the term of this patent is extended or adjusted under 35 U.S.C. 154(b) by 0 days.

(21) Appl. No.: 16/237,741

(22) Filed: Jan. 1, 2019

(51) Int. Cl.
*H04R 1/02* (2006.01)
*H04R 1/42* (2006.01)

(52) U.S. Cl.
CPC ..... *H04R 1/42* (2013.01); *H04R 1/025* (2013.01)

(58) Field of Classification Search
CPC ..... H04R 1/42; H04R 1/025
See application file for complete search history.

(56) References Cited

U.S. PATENT DOCUMENTS 2,797,766 A * 7/1957 Sullivan ..... H04R 1/42 181/151
4,750,585 A * 6/1988 Collings ..... H04R 1/2888 181/148

* cited by examiner

*Primary Examiner* — Brian Ensey
(74) *Attorney, Agent, or Firm* — Chuck Bagg; Chuck-full of Ideas

(57) ABSTRACT

An acoustic suspension speaker enclosure is filled with a heavy gas, which has a much lower sonic velocity than air. This allows the enclosure to operate at a much lower frequency, in direct proportional to the reduction in sonic velocity.

5 Claims, 4 Drawing Sheets

GAS-FILLED ACOUSTIC SUSPENSION SPEAKER

CROSS REFERENCE TO RELATED PATENTS

Not Applicable

STATEMENT OF FEDERALLY SPONSORED RESEARCH

Not Applicable

PARTIES TO A JOINT RESEARCH AGREEMENT

Not Applicable

REFERENCE TO A SEQUENCE LISTING, TABLE, OR COMPUTER PROGRAM

Not Applicable

BACKGROUND OF THE INVENTION

A conventional loudspeaker produces sound by using a moving diaphragm or cone to create pressure waves in the surrounding air. As the diaphragm moves forward, it creates a high pressure peak at its front, and a low pressure trough at its back, such that the front wave and back wave are 180 degrees out of phase. If these waves are allowed to merge and mix together, there will be randomly distributed constructive and destructive wave interference at various wavelengths and locations, resulting in an uneven sound field in the listening area. Loudspeakers are typically mounted in some type of baffle or enclosure designed to keep the front wave and back wave separate. This becomes more important at the lower end of the frequency range where the wavelengths are several feet in length. It also becomes more difficult because at the lower frequencies, the enclosure needs to be larger to accommodate the longer wavelengths.

At some frequency, a speaker enclosure will become a resonant chamber, and will get much louder, while the amplitude of the driving signal is held constant. A transient may even cause it to ring at it's resonant frequency. Thus, it will greatly color or distort the sound. Packing the enclosure with fiberglass batting, or lining the interior walls with acoustic foam can reduce these effects, but enclosures typically cannot function effectively at or below resonance.

The two most common low frequency speaker enclosures are the "bass reflex" type (also known as "tuned port"), and the "acoustic suspension" type. A bass reflex box can extend its low frequency range by phase shifting the back wave through a delay path so it partially cancels the front wave at the resonant frequency, but constructively adds to the front wave at some frequency below the natural resonance. However, the resulting sound is often described as "boomy" near the center frequency of the tuned port, or muddy at other frequencies, where the phase shifting is not optimal. Also, the suspension of the cone has to be somewhat stiff to control the excursion during transients and loud bass notes. The characteristics of the physical suspension can color the sound and produce unwanted artifacts.

An acoustic suspension unit is inherently less efficient because only the front wave leaves the box. The back wave is absorbed and dissipated inside the box. However, an acoustic suspension enclosure typically produces cleaner sound with less distortion. Since the enclosed air acts as a perfect spring to control the cone excursion, the speaker cone can use a softer more compliant suspension. In spite of the better sound quality, acoustic suspension speakers have recently been less popular, because until now, the only way to lower the resonant frequency of such an enclosure was to make it physically larger.

BRIEF SUMMARY OF THE INVENTION

The low frequency limit of a given size acoustic suspension speaker enclosure is based on the relationship between the enclosure dimensions and the wavelength of the sound. The wavelength at a given frequency is determined by the sonic velocity in air. The present invention overcomes this limit by replacing the air with a heavy gas in which the sonic velocity is lower, resulting in a shorter wavelength, which lowers the resonant frequency of the enclosure. Now the bass range of a given size can be extended, or the enclosure can be made smaller.

It should be noted that these are simplified drawings to illustrate the basic concepts. While they depict a cabinet built of flat panels with sharp corners, actual construction would at least round off all the corners and edges in the horn sections, and could even be made up of curved panels to produce a more refined horn shape, and to reduce parasitic resonance.

DETAILED DESCRIPTION

Figure 1:
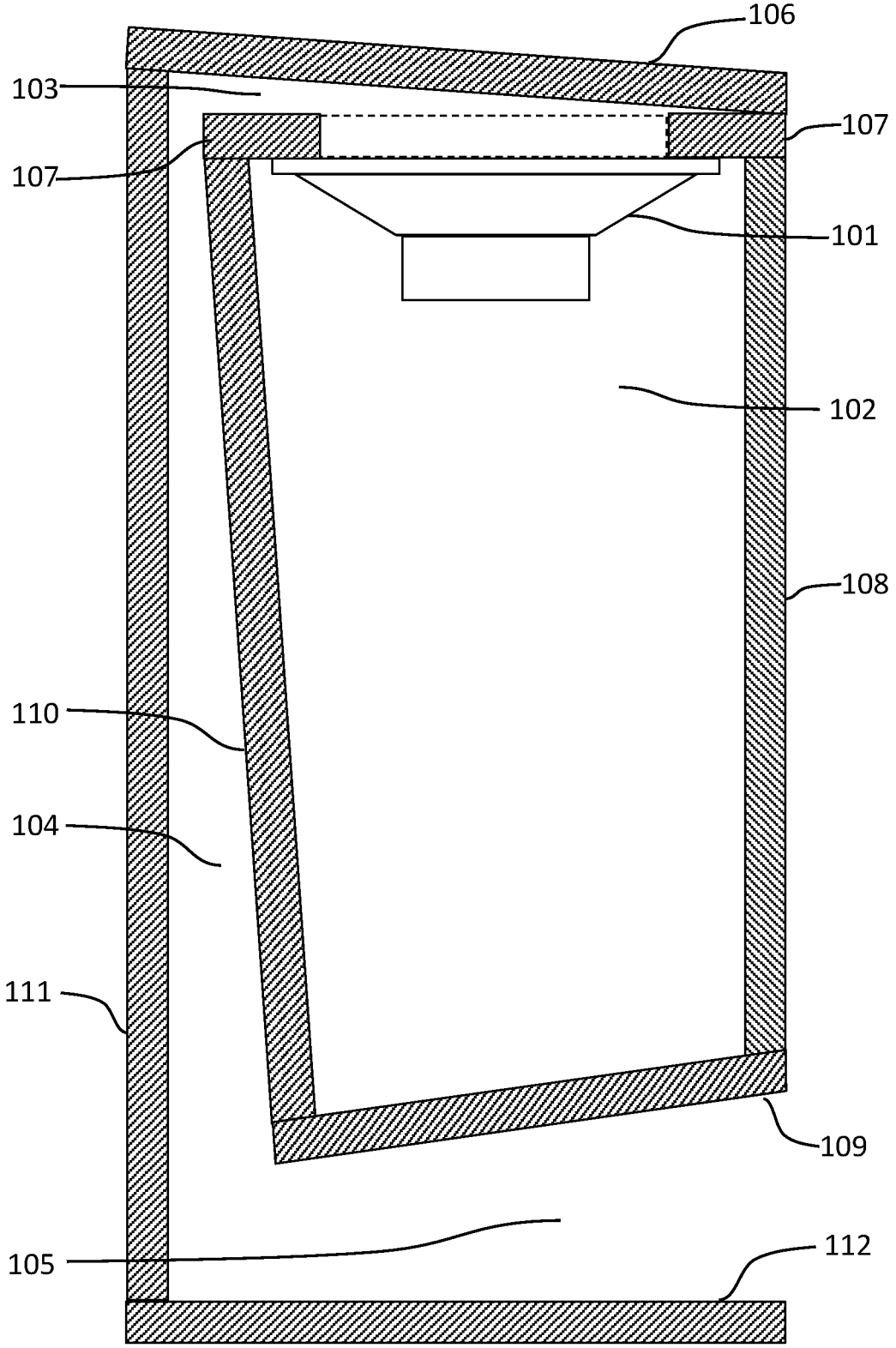
FIG. 1 is a schematic representation of the gas-filled and horn-loaded speaker enclosure cabinet as seen from the side, with the side panels removed.

Many sub-woofer speaker enclosures have the heavy speaker mounted at the bottom of the box for stability, and possibly to couple the low frequency sound into the floor. Because the gas in this enclosure is significantly heavier than air, the weight of the gas would tend to push the cone outward, reducing it's useful travel. This may be a subtle effect, and a dedicated speaker design could neutralize it, but it would still be preferable to mount the speaker 101 in the top of the box, as in FIG. 1. The sealed volume of heavy gas 102 contained inside the box below the speaker, acts as a resilient spring force to return the very limp cone suspension to its neutral position after an excursion, the same as in a conventional acoustic suspension speaker.

But in this case, the back wave from the speaker travels more slowly through the heavy gas 102 than it would through air. If the sound travels half as fast in the heavy gas, it's wavelength would be half as long, and the resonant frequency of the box would be reduced by half. As a practical example, if the enclosure were designed to have a resonant frequency of 60 Hz using air, filling it with sulfur hexafluoride would lower the resonant frequency to 23.27 Hz. There are several other readily available gasses that are suitable for this application, but it may be possible for chemists to synthesize a custom gas specifically designed for even lower sonic velocity.

The sealed enclosure itself is made up of the speaker mounting panel 107, the front panel 108, the bottom panel 109, and the back panel 110. It is also enclosed by the two side panels, 113 and 114, shown in the other three views. It may be noted that none of the panels, including the side panels, are parallel or perpendicular to each other, which helps to reduce standing waves and lower the Q of any resonant peaks. The speaker mounting panel is level, to help the speaker cone remain centered.

Although the gas-filled acoustic suspension enclosure can be used by itself as a direct radiator speaker system, it may also be combined with a relatively conventional folded horn to increase its efficiency. The horn acts as an "acoustic transformer" to better match the acoustic impedance of the speaker with that of the free air in the listening environment. In the embodiment shown in the drawings, the horn is folded into three sections. The speaker 101 feeds into the first section of the horn 103, then down into the vertical section 104, and finally into the bottom section 105. These expanding horn sections are formed between the enclosure itself, and the outer panels of the cabinet including the top 106, the back 111, and the bottom 112. The edges of the horn are formed by six ribs 115 thru 120 (not shown in FIG. 1) which help to hold the enclosure rigidly in place inside the cabinet. These ribs are angled outwardly along the length of the horn to allow its volume to expand in two orthogonal planes.

Figure 2:
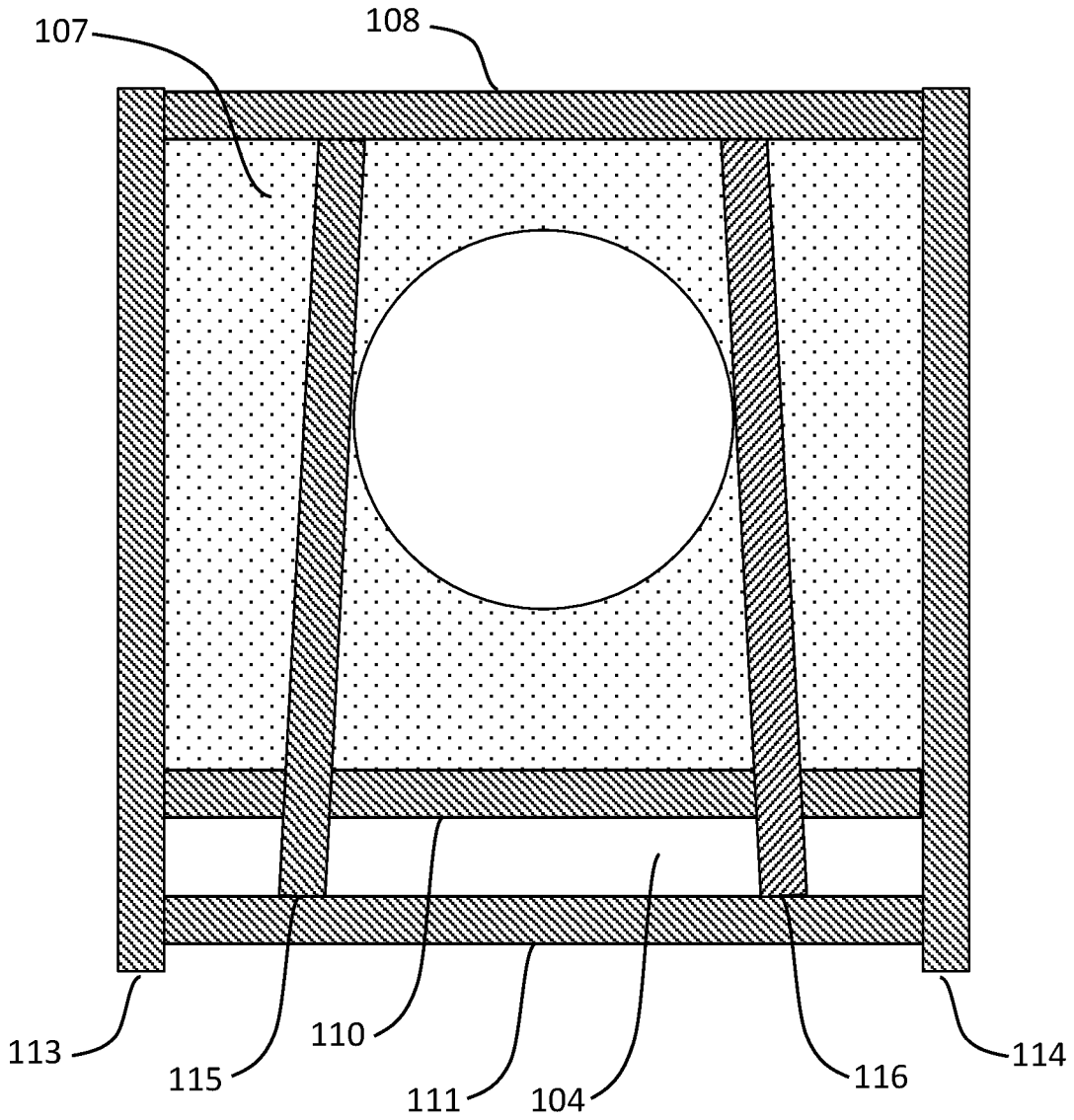
FIG. 2 shows the cabinet as seen from above with the top removed.

FIG. 2 is a top view, with the top panel 106 removed. It shows the side panels, 113 and 114, along with the front panel 108, the back of the enclosure 110, and the back of the cabinet 111. It also shows the first two ribs 115 and 116, and the surface of the speaker mounting panel with a circular opening for the speaker. 104 indicates the space forming the second section of the horn.

Figure 3:
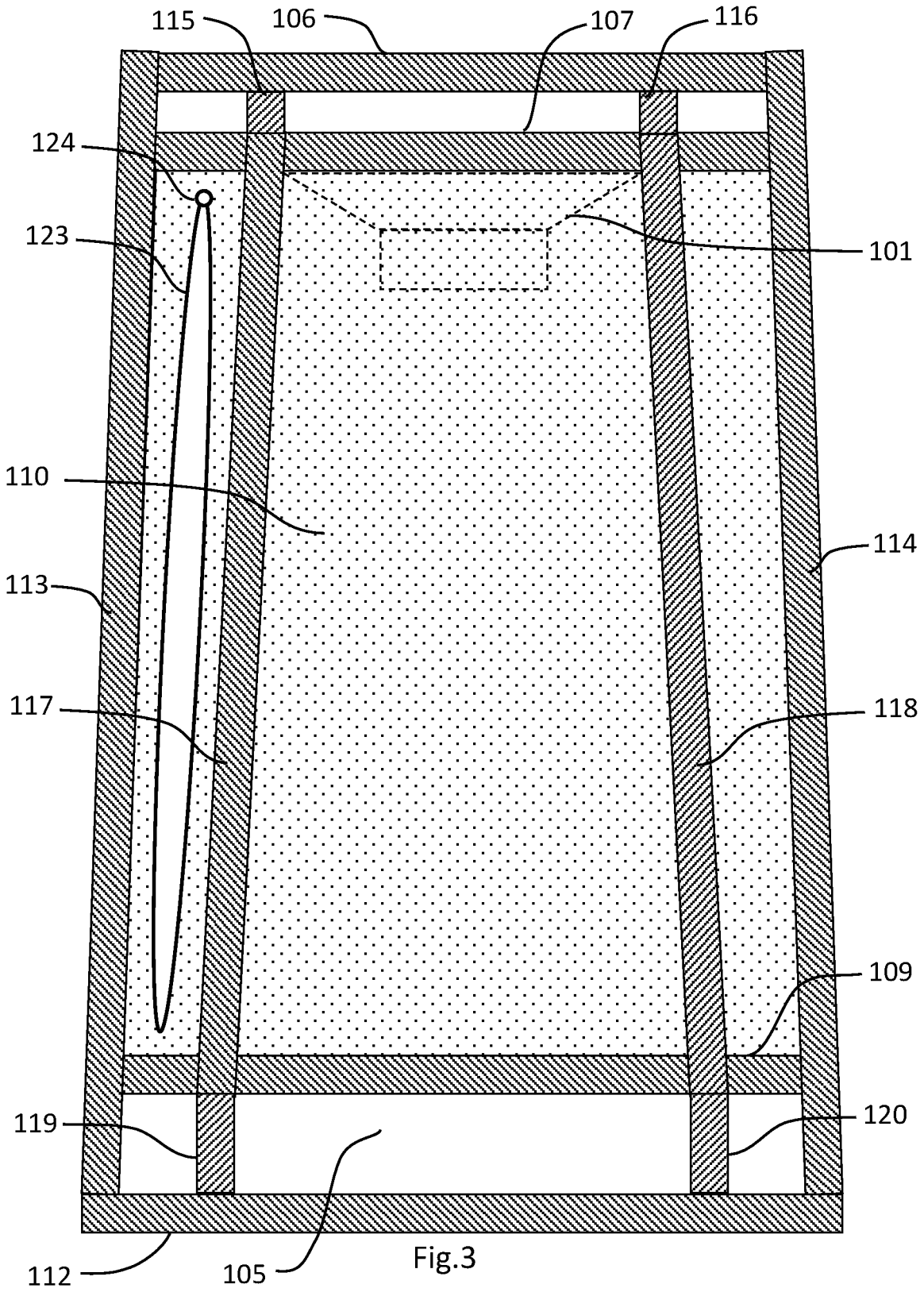
FIG. 3 shows the cabinet as seen from the back, with the back panel removed.

FIG. 3 is a rear view, with the rear panel removed. Here it can be seen that the two side panels, 113 and 114, slope outwardly toward the bottom, both to make the sides of the enclosure non-parallel, and to allow more room for the horn expansion. The top panel 106, the speaker mounting panel 107, the enclosure bottom 109, the cabinet bottom 112, and the surface of the back panel 110 of the enclosure are all visible. Ribs 117 and 118 slope outwardly to form the edges of the second horn section. 105 indicates the space forming the third section of the horn. A bladder 123, which is used to compensate for temperature and pressure changes is also shown.

Figure 4:
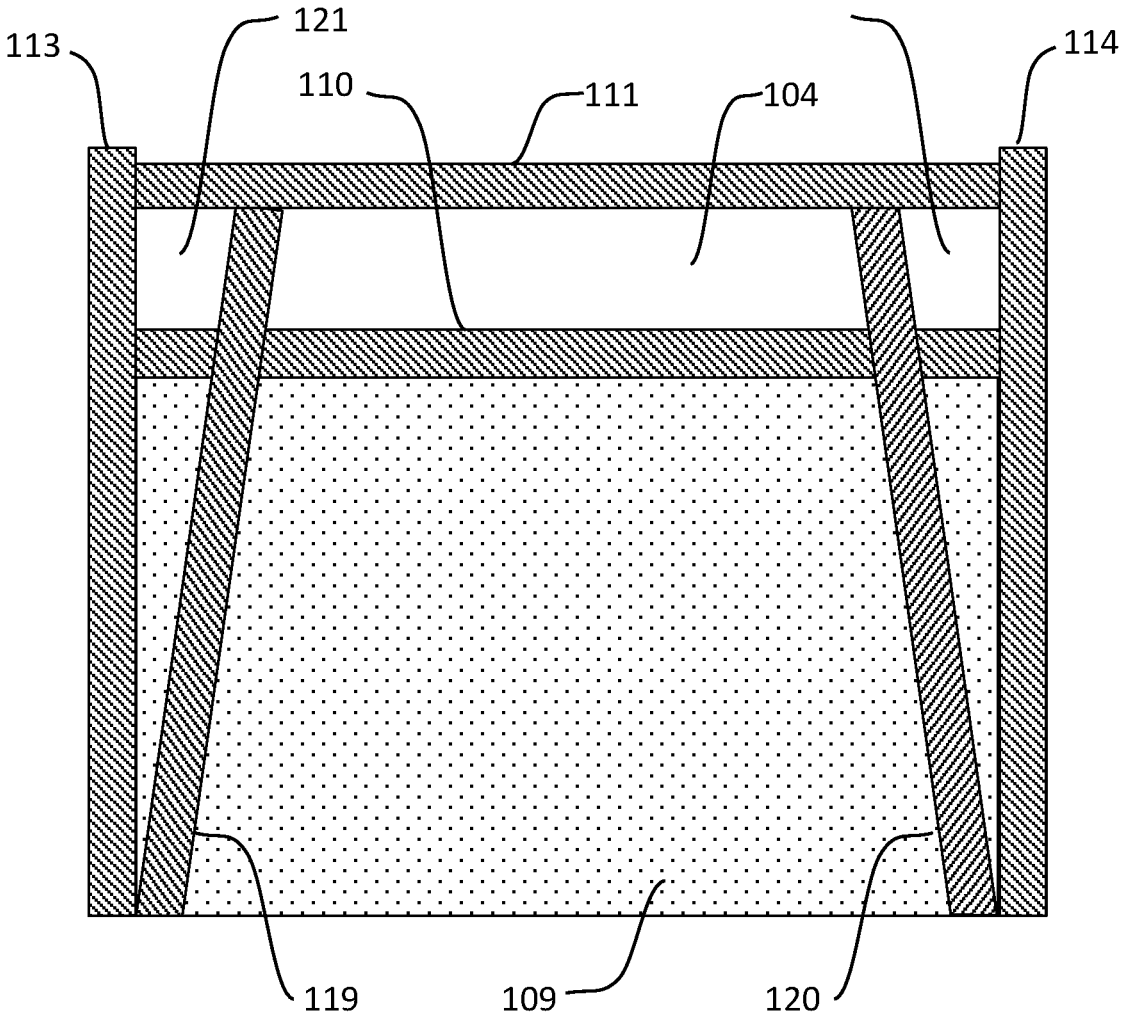
FIG. 4 shows the cabinet as seen from the bottom, with the bottom panel removed.

FIG. 4 is a bottom view with the bottom panel removed, showing the side panels 113 and 114, the back panel of the enclosure 110, the back panel of the cabinet 111, and the surface of the bottom panel of the enclosure. It also shows the last two ribs 119 and 120, which slope outwardly to form the edges of the third section of the horn. 104 indicates the space forming the second section of the horn. There are also two empty spaces or plenums 121 and 122 between the sealed enclosure and the outer cabinet, and outside the path of the horn.

The acoustic suspension enclosure is often referred as a "sealed" box because it has no obvious vents or ports. However, it cannot be completely sealed, because if the temperature of the air inside changes, it will expand or contract, displacing the speaker cone outward or inward. If the external barometric pressure decreases or increases, again it will force the cone outward or inward. A large sudden change could even damage the cone or its suspension. To protect the speaker from damage, the enclosure must actually be somewhat leaky. The cone itself could be porous, or a controlled leak could be provided at the wire connection interface.

However, with a gas-filled enclosure, we do not want the heavy gas to leak out or air to leak in. We must provide another method of equalizing the pressure to protect the cone and keep it centered. We can do this with an expansion bladder 123. As shown in the drawings, there are two empty spaces or plenums 121 and 122, and a soft flexible airtight bladder can be mounted in one or both of those spaces. A small tube 124 connects the bladder to the interior of the enclosure, so that some gas can flow back and forth between them, but not enough to affect the acoustic behavior. The space around the bladder has a small vent connecting to the outside air. Under normal conditions, the bladder would be half full of the heavy gas. Changes in temperature or pressure would cause the bladder or bladders to expand or contract as needed to equalize the pressure inside the enclosure.

I claim a gas filled speaker enclosure comprising:

1. A gas filled speaker enclosure, comprising: an acoustic suspension type sealed speaker enclosure for producing audible sound, said enclosure having a natural tendency to resonate at some audible frequency, said enclosure being filled with a heavy gas instead of air, said heavy gas having a sonic velocity significantly lower than the sonic velocity of air, said lower sonic velocity resulting in a shorter wavelength for said sound, said shorter wavelength resulting in the enclosure having a significantly lower resonant frequency than if it were filled with air, said enclosure being connected to at least one flexible air-tight bladder, said bladder being exposed to the surrounding air outside the enclosure, such that said heavy gas may slowly pass back and forth between said bladder and said enclosure to equalize any ambient pressure differential between the enclosure and the surrounding air.

2. A gas filled speaker enclosure as in claim 1 having a horizontal top panel for mounting a speaker such that the speaker does not have to support the weight of the heavy gas.

3. A gas filled speaker enclosure as in claim 1 having an asymmetrical shape, said shape reducing the formation and strength of any standing waves, said reduction of standing waves resulting in the weakening of any resonant peaks.

4. A gas filled speaker enclosure as in claim 1 coupled to an external acoustic horn, said horn serving to increase the efficiency of said speaker enclosure, said horn may be folded and wrapped around the enclosure in a compact shape.

5. An acoustic suspension type sealed speaker enclosure for producing audible sound, said enclosure having a natural tendency to resonate at some audible frequency, said enclosure being filled with a heavy gas instead of air, said heavy gas having a sonic velocity significantly lower than the sonic velocity of air, said lower sonic velocity resulting in a shorter wavelength for said sound, said shorter wavelength resulting in the enclosure having a significantly lower resonant frequency than if it were filled with air, said enclosure being connected to at least one flexible air-tight bladder, said bladder being exposed to the surrounding air outside the enclosure, such that said heavy gas may slowly pass back and forth between said bladder and said enclosure to equalize any ambient pressure differential between the enclosure and the surrounding air, said enclosure having a top panel for mounting a speaker such that the speaker does not have to support the weight of the heavy gas, said enclosure having an asymmetrical shape, said shape reducing the formation and strength of any standing waves, said enclosure being coupled to an external acoustic horn, which may be folded and wrapped around the enclosure, said horn serving to increase the efficiency of said speaker enclosure.

* * * * *